US006296123B1

(12) United States Patent
Zakeri et al.

(10) Patent No.: US 6,296,123 B1
(45) Date of Patent: Oct. 2, 2001

(54) BOTTLE REJECT SYSTEM

(75) Inventors: Saeid Zakeri, Elmira Heights; Mark P. Claypool, Horseheads; William J. Furnas, Elmira, all of NY (US)

(73) Assignee: Emhart Glass S.A., Cham (CH)

( * ) Notice: Subject to any disclaimer, the term of this patent is extended or adjusted under 35 U.S.C. 154(b) by 0 days.

(21) Appl. No.: 09/694,471

(22) Filed: Oct. 23, 2000

(51) Int. Cl.[7] ..... B07C 5/00
(52) U.S. Cl. ..... 209/522; 209/523
(58) Field of Search ..... 209/522, 523, 209/524, 559, 562, 566, 564, 644, 656, 657, 932

(56) References Cited

U.S. PATENT DOCUMENTS 4,431,436 * 2/1984 Lulejian ..... 65/169
4,479,582 * 10/1984 Ducloux ..... 209/552
4,614,531 * 9/1986 Bishop et al. ..... 65/168
4,639,263 * 1/1987 Kulikauskas ..... 65/168
4,691,231 * 9/1987 Fitzmorris et al. ..... 358/106
4,884,678 * 12/1989 Graham et al. ..... 198/392
5,388,705 * 2/1995 Fine et al. ..... 209/524

* cited by examiner

*Primary Examiner*—Donald P. Walsh
*Assistant Examiner*—Joseph C Rodriguez
(74) *Attorney, Agent, or Firm*—Spencer T. Smith

(57) ABSTRACT

A bottle reject system comprising a conveyor for carrying formed bottles, a first rejector operated at a time selected so that a defective bottle will be removed from the conveyor, a first sensor for confirming that the operation of the first rejector removed a bottle from the conveyor, and a second rejector operable at a time selected so that in the event the defective bottle was not removed from the conveyor when the first rejector operated, the defective bottle would be removed by operation of the second rejector at that time, and a control for operating the second rejector at the selected time, in the event that the first sensor fails to confirm that the operation of the first rejector removed a bottle from the conveyor.

3 Claims, 4 Drawing Sheets

FIG. 2

| | STATE | INPUTS | | | | OUTPUT |
|---|---|---|---|---|---|---|
| | | REACQUIRE | PASS | REJECT | CHUTE | 2nd REJECT |
| 1 | NORMAL PASS | X | X | 0 | 0 | 0 |
| 2 | NORMAL PASS | X | X | 0 | X | 0 |
| 3 | NORMAL REJECT (NO PASS AVAILABLE) | X | X | X | 0 | X |
| 4 | NORMAL REJECT (NO PASS AVAILABLE) | X | X | X | X | 0 |
| 5 | NORMAL REJECT (NO PASS AVAILABLE) | X | 0 | X | 0 | X |
| 6 | NORMAL REJECT | X | 0 | X | X | 0 |
| 7 | NO STATUS | X | 0 | 0 | 0 | X |
| 8 | NO STATUS | X | 0 | 0 | X | 0 |
| 9 | NO WARE | 0 | 0 | 0 | 0 | 0 |
| 10 | NO WARE | 0 | 0 | 0 | X | 0 |
| 11 | NORMAL REJECT | 0 | 0 | X | 0 | X |
| 12 | NORMAL REJECT | 0 | 0 | X | X | 0 |
| 13 | NORMAL PASS | 0 | X | 0 | 0 | 0 |
| 14 | NORMAL PASS | 0 | X | 0 | X | 0 |
| 15 | NORMAL REJECT (NO PASS) | 0 | X | X | 0 | X |
| 16 | NORMAL REJECT (NO PASS) | 0 | X | X | X | 0 |

BOTTLE REJECT SYSTEM

The present invention relates to glass bottle inspection equipment and more specifically to equipment for removing defective bottles from a conveyor before they can be confused with good bottles.

BACKGROUND OF THE INVENTION

Glass bottles are conventionally formed in an I.S. (individual section) machine. The process is complex and the formed bottle can have a number of defects. Formed bottles are displaced by a conveyor to a packing location. Inspection equipment identifies bottles with these defects and a reject mechanism which will know when the defective bottle is in front of it, will remove a defective bottle from the conveyor with an air jet or with a kicker mechanism.

OBJECT OF THE INVENTION

It is accordingly an object of the present invention to provide a bottle reject system which will be more efficient in rejecting bad bottles.

Other objects and advantages of the present invention will become apparent from the following portion of this specification and from the accompanying drawings which illustrate in accordance with the mandate of the patent statutes a presently preferred embodiment incorporating the principles of the invention.

BRIEF DESCRIPTION OF THE DRAWINGS

FIG. 2 is a truth table illustrating the operation of the system;

BRIEF DESCRIPTION OF THE PREFERRED EMBODIMENT

Figure 1:
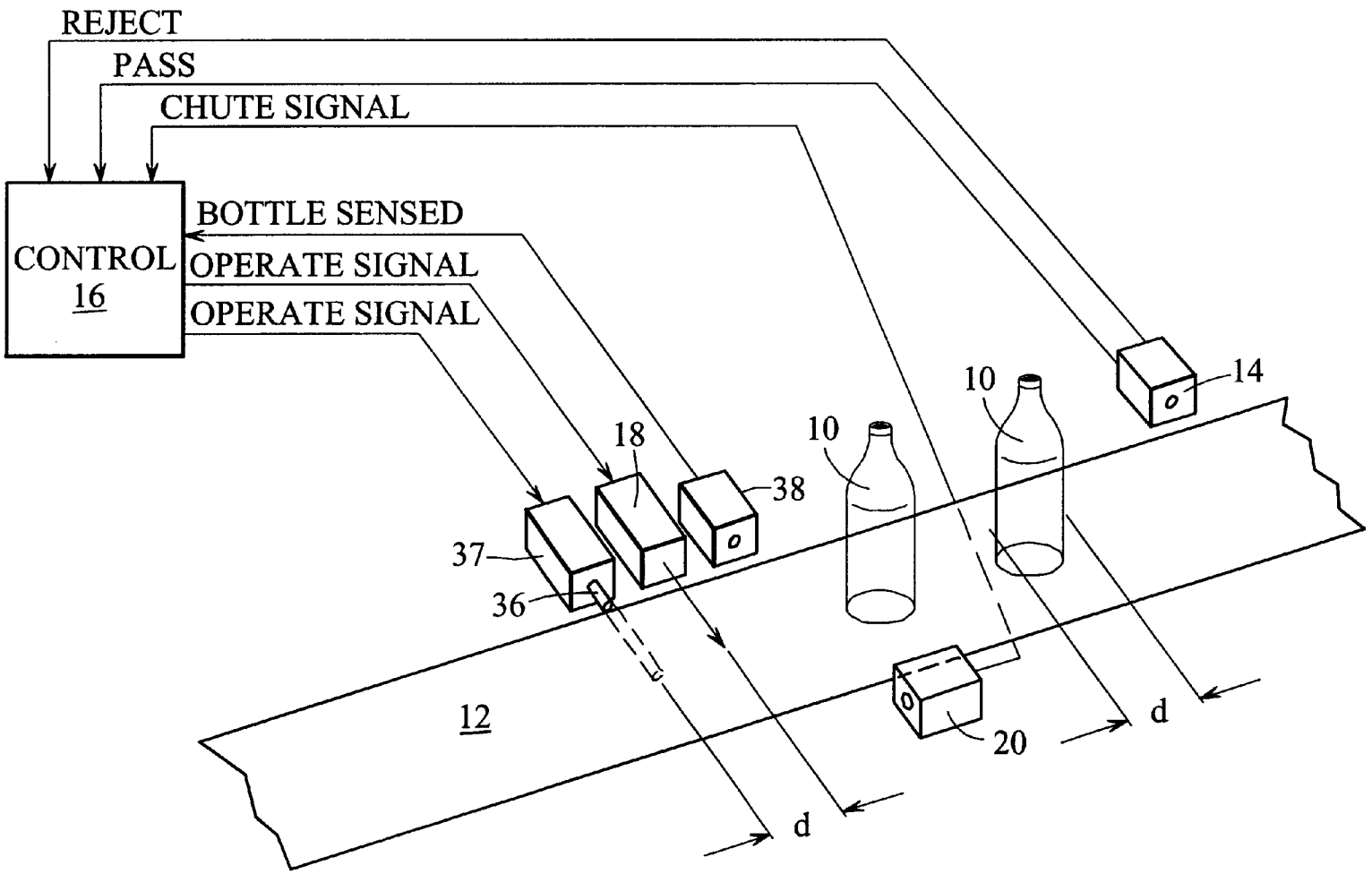
FIG. 1 is a perspective schematic view of a bottle reject system made in accordance with the teachings of the present invention.

FIG. 1 shows a series of formed bottles 10 having a diameter d being carried by a conveyor 12 past at least one inspection device 14 which will send a Pass signal to the control 16 if the bottle passes the inspection and a Reject signal to the control 16 if the bottle fails the inspection. A #1 rejector (an air nozzle or the like) 18 can be operated with an Operate Signal from the control when the rejected bottle is in front of the air nozzle to blow the bottle off the conveyor into a suitable chute or collector (not shown). A chute sensor 20 will confirm that a bottle has been blown off the conveyor by supplying a Chute Signal to the control.

Upstream of the #1 rejector is a reacquire sensor 38 which supplies a Bottle Sensed signal to the control and downstream one bottle diameter d from the #1 rejector, is a #2 rejector 37 which has a pneumatically or electrically operated plunger 36.

The truth table illustrates the operation of the system. In state 1 (normal pass), the reacquire sensor senses a bottle, a pass signal is present and no reject signal is present, no signal is supplied to the #1 rejector, no signal comes from the chute sensor and no signal is supplied to the #2 rejector. State 2 is the same as state 1 except that a chute signal is received which indicates that the chute sensor is blocked.

State 13 is the same as state 1 except that a signal is not received from the reacquire sensor which indicates that this sensor is not operating. State 14 is the same as state 13 with the addition of a signal from the chute sensor additionally indicating that the chute is blocked.

State 6 shows normal rejection where the bottle is sensed by the reacquire sensor, there is no pass signal but there is a reject signal, and a signal is received from the chute sensor showing that the #1 rejector successfully rejected the bottle. State five is the same as state 6, except that the chute signal is missing thereby requiring the operation of the #2 rejector. State 4 is the same as state 6 except that pass and reject signals have issued. The reject signal has priority and the chute signal confirms the bottle was rejected. The reject has priority, but the chute sensor did not sense the reject, so the #2 rejector is activated. State 3 is the same as state 5 except that there is a pass signal in addition to the reject signal. States 7 and 8 deal with the situation where the reacquire sensor senses a bottle but there is neither a pass or reject signal. This causes the rejector to fire as a failsafe to prevent bottles with no status from passing. The chute sensor detects the rejected bottle and no further action is required. If no signal is sensed by the chute signal the #2 rejector will operate to remove the bottle (state 7). State 9 is a quiescent system with no signals and state 10 is the same as state 9 except that a chute signal exists indicating that the chute sensor is blocked. State 12 is the same as state 6 but the reacquire sensor is not operating. State 11 is the same as state 5 but the reacquire sensor is not operating. State 15 is the same as state 3 but the reacquire sensor is not operating. And state 16 is the same as state 4 but the reacquire sensor is not operating.

Figure 3:
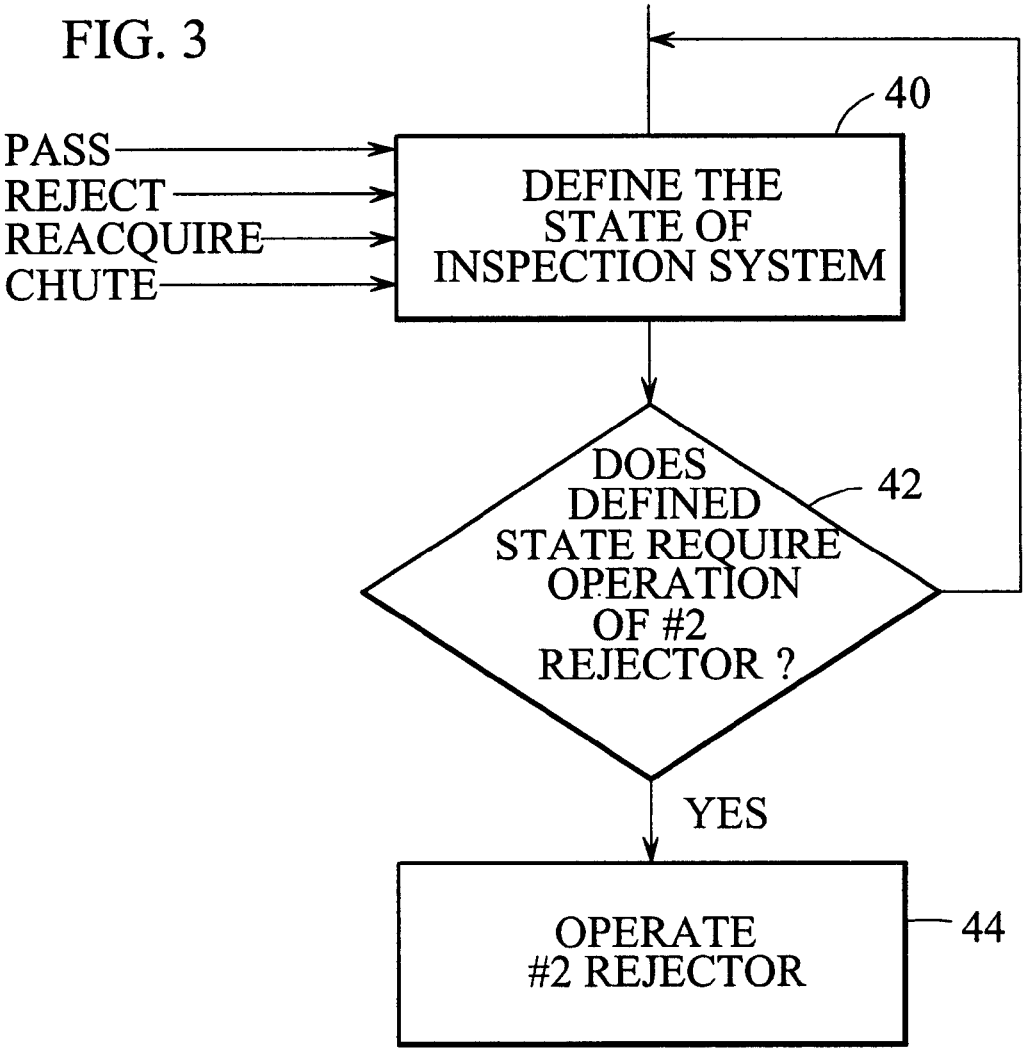
FIG. 3 is logic diagram illustrating the operation of the bottle reject system.
Figure 4:
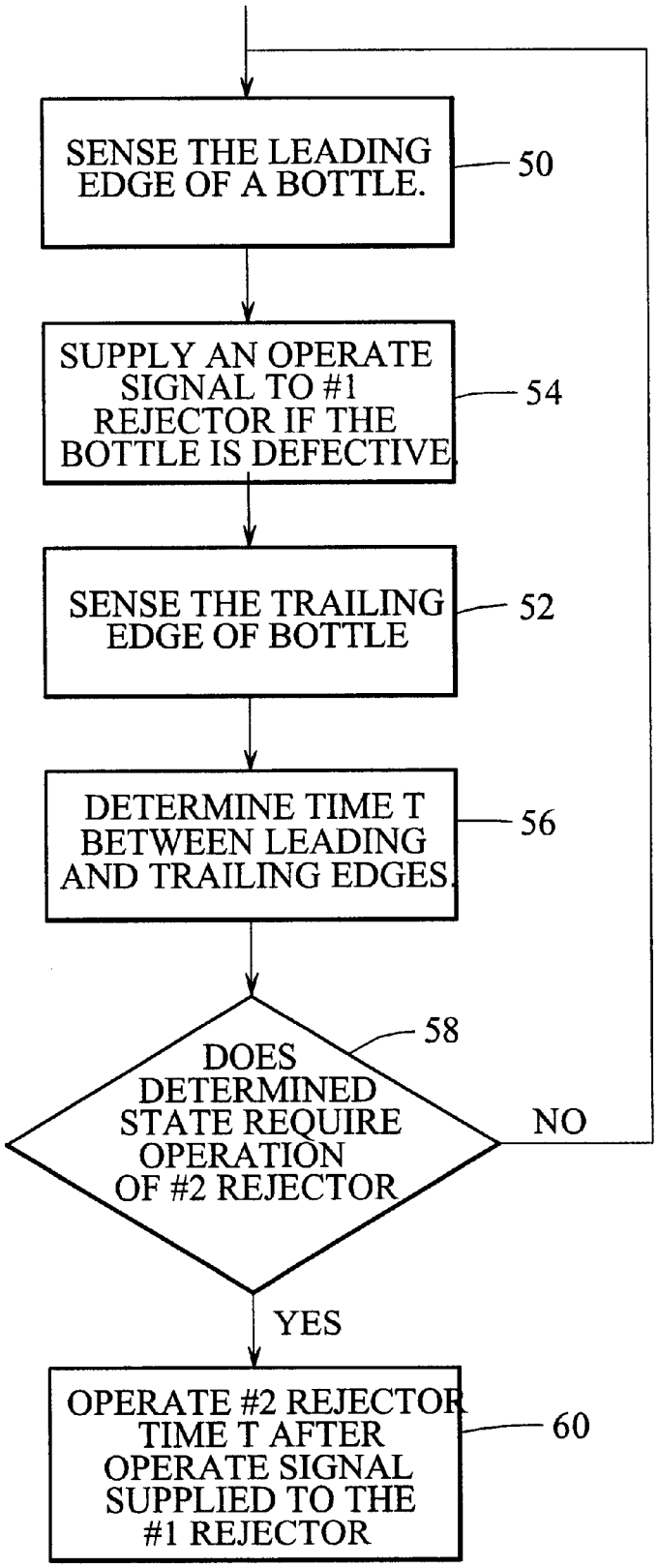
FIG. 4 is a logic diagram illustrating the control of the second rejector.

FIG. 3 is a logic diagram of the system. The control will Define The State Of The Inspection System 40 with the pass, reject, reacquire and chute signals as inputs, and if the control answers the query "Does Defined State Require Operation Of #2 Rejector? 42 in the affirmative, the control will Operate #2 Rejector 44 to knock the bottle off the conveyor.

The reacquire sensor Senses The Leading Edge Of A Bottle 50. The reacquire sensor is located close enough to the #1 rejector that before the reacquire sensor Senses The Trailing Edge Of The Bottle 52, the control will Supply An Operate Signal to #1 Rejector If The Bottle Is Defective 54. The control will Determine Time T Between Leading And Trailing Edges 56 and should the control answer the query Does Determined State Require Operation Of #2 Rejector 58 in the affirmative, the control will Operate #2 Rejector Time T After Operate Signal Is Supplied To The #1 Rejector 60 (the rejectors are one d apart). To facilitate setting the rejectors one d apart, the location of the #2 rejector is adjustable.

States 2, 8 and 10 are error states indicating a faulty chute sensor. States 11–16 indicate a faulty reacquire sensor. States 3, 4, 15 and 16 indicate a malfunctioning inspection system giving both pass and reject signals. Any one of the above states can generate an alarm and/or turn off the conveyor or inspection system.

What is claimed is:

1. A bottle reject system comprising a conveyor for carrying formed bottles, an inspection device for inspecting bottles carried by said conveyor and for issuing a pass signal in the event an inspected bottle is not found to be defective and for issuing a reject signal in the event an inspected bottle is found to be defective and a first rejector located downstream of said inspection device for removing a defective bottle from the conveyor, a chute sensor for issuing a chute signal confirming that the operation of the first rejector removed a bottle from the conveyor, a reacquire sensor located intermediate said inspection device and said first rejector for issuing a reacquire signal indicating the presence of a bottle, a second rejector located downstream of said first rejector for removing a bottle from the conveyor, and a control for receiving
a pass signal,
a reject signal,
a reacquire signal, and
a chute signal, the presence or absence of each of these signals defining a control state, said control operable to selectively issue an operate signal to said first rejector when a defective bottle is in front thereof, and said control comprising means for issuing an operate signal to said second rejector when that defective bottle would be in front thereof when one of a plurality of selected control states exist.

2. A bottle reject system according to claim 1, wherein said first rejector comprises an air nozzle and said second rejector comprises an advanceable plunger.

3. A bottle reject system according to claim 1, wherein said first rejector and said second rejector are one bottle diameter apart, said control further comprising means for determining the time between the sensing of the leading and trailing edges of a bottle by said reacquire sensor and means for operating the second rejector said time after an operate signal is supplied to said first rejector in the event one of said plurality of selected states exist.

* * * * *